United States Patent [19]

Okouchi et al.

[11] 4,435,285

[45] Mar. 6, 1984

[54] SORTING APPARATUS

[75] Inventors: Isao Okouchi; Sankichi Takahashi; Yasuteru Mukai; Katsumoto Otake; Takuya Sasaki, all of Hitachi; Masahiko Miyai, Mito, all of Japan

[73] Assignee: Hitachi, Ltd., Tokyo, Japan

[21] Appl. No.: 278,994

[22] Filed: Jun. 30, 1981

[30] Foreign Application Priority Data

Jun. 30, 1980 [JP] Japan ..... 55-89717

[51] Int. Cl.[3] ..... B03B 7/00; B07B 1/06; F28G 1/00

[52] U.S. Cl. ..... 209/250; 15/3.51; 15/104.06 A; 165/95; 209/17; 209/211

[58] Field of Search ..... 209/659, 680, 211, 250, 209/273, 17, 235, 305; 165/95; 15/3.51, 104.06 A

[56] References Cited

U.S. PATENT DOCUMENTS

| | | | |
|---|---|---|---|
| 1,795,348 | 3/1931 | Schmidt | 165/95 |
| 2,094,438 | 9/1937 | Watson | 209/250 |
| 2,801,824 | 8/1957 | Taprogge | 165/95 |
| 3,303,525 | 2/1967 | Peoples et al. | 15/104.06 A |
| 3,794,164 | 2/1974 | Ginaven | 209/305 X |
| 3,841,397 | 10/1974 | Eimer | 165/95 |
| 4,314,604 | 2/1982 | Koller | 165/95 |

*Primary Examiner*—Robert B. Reeves
*Assistant Examiner*—Edward M. Wacyra
*Attorney, Agent, or Firm*—Antonelli, Terry & Wands

[57] ABSTRACT

A sorting apparatus for sorting elastic balls for cleaning the inner surfaces of heat transfer tubes of a heat exchanger. The apparatus comprises a casing having a cylindrical cross-section, an inlet pipe connected to an upper portion of the wall of the casing and adapted to introduce the elastic balls together with the cooling water, a substantially frusto-conical separation sleeve disposed at the center of the casing and having a peripheral wall in which formed are a multiplicity of apertures shaped and sized to permit only the worn out elastic balls smaller than a predetermined size to pass therethrough, an annular swirling passage defined between the inner peripheral surface of the casing and the outer peripheral surface of the separation sleeve and adpated to impart a swirl to the cooling water suspending the elastic balls and introduced into the casing, an outlet pipe connected to a lower portion of the wall of the casing and adapted for taking out the valid elastic balls greater than the predetermined size, and a discharge pipe also connected to the casing and adapted for discharging the worn out elastic balls which have been introduced into the separation sleeve.

13 Claims, 4 Drawing Figures

SORTING APPARATUS

BACKGROUND OF THE INVENTION

The present invention relates to a sorting apparatus for sorting bodies suspended in a liquid according to the sizes of the bodies and, more particularly, to a sorting apparatus for sorting cleaning elastic balls used for cleaning tubes of heat exchangers in accordance with relative sizes of the cleaning balls.

Plants having steam turbines incorporate a condenser which is usually a heat exchanger of shell-and-tube type. For maintaining the desired high efficiency of the plant, it is necessary to clean inner surfaces of the cooling tubes of the condenser by removing mud and other contaminants attached to the tube inner surfaces. Previously, in order to keep the tube inner surfaces clean, elastic cleaning balls such as, for example, sponge balls have been fed into the cooling water to circulate through the condenser together with the cooling water thereby mechanically removing the contaminants from the inner surfaces of the condenser tubes. The sponge balls used had a diameter somewhat greater than the inside diameter of the cooling tubes. However, these balls are gradually worn and, consequently, the diameter of the respective balls is reduced over a period of time, thereby resulting in lowered cleaning effect. This gives a rise to a demand for a suitable sorting apparatus which can sort the unacceptably worn sponge balls from the other sponge balls still having acceptably large diameters to permit the worn sponge balls to be disposed to the outside of the cooling water system.

U.S. Pat. No. 3,841,397 discloses a sorting apparatus, in which a sorting basket, having apertures through which the worn sponge balls are extracted and sorted, is attached only to one side of the internal space of a barrel of the apparatus. This sorting apparatus, however, can operate only at an impractically low sorting efficiency and often fails in the sorting of the worn sponge balls, because the sorting operation relies solely upon a dynamic pressure of the cooling water.

SUMMARY OF THE INVENTION

Accordingly, an object of the invention is to provide a sorting apparatus capable of sorting bodies suspended in a liquid according to the sizes of the bodies.

Another object of the invention is to provide a sorting apparatus capable of sorting worn cleaning elastic balls for cleaning inner surfaces of heat transfer tubes of a heat exchanger, out of the elastic balls circulated through the heat exchanger together with the cooling water.

To these ends, according to the invention, a sorting apparatus is provided having a casing into which the bodies to be sorted are introduced together with a liquid, a separation sleeve is disposed at a center of the space in the casing and has a cylindrical wall having a plurality of openings of a predetermined sorting size. A swirling flow passage imparts a swirl to the liquid suspending the bodies introduced into the annular space between the inner peripheral surface of the casing and the outer peripheral surface of the separation sleeve so as to promote the separation of the bodies by the centrifugal force generated as a result of the swirl. A discharge pipe, through which the bodies separated from others and permitted to come into the separation sleeve, enable a discharge of the bodies out of the latter to the outside of the sorting apparatus, and an outlet pipe introduce the bodies other than those separated to the outside of the sorting apparatus.

The above and other objects, as well as advantageous features of the invention will become more apparent from the following description of the invention taken in conjunction with the accompanying drawings.

BRIEF DESCRIPTION OF THE INVENTION

DESCRIPTION OF THE PREFERRED EMBODIMENTS

Figure 1:
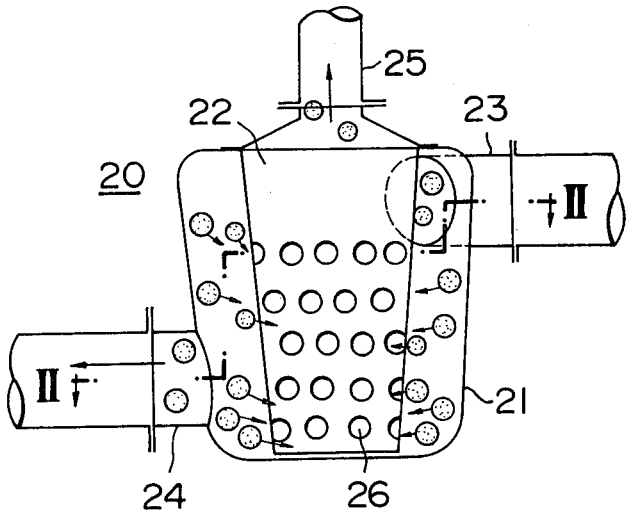
FIG. 1 is a vertical cross-sectional view of the construction of a sorting apparatus for sorting cleaning sponge balls, in accordance with the invention.
Figure 2:
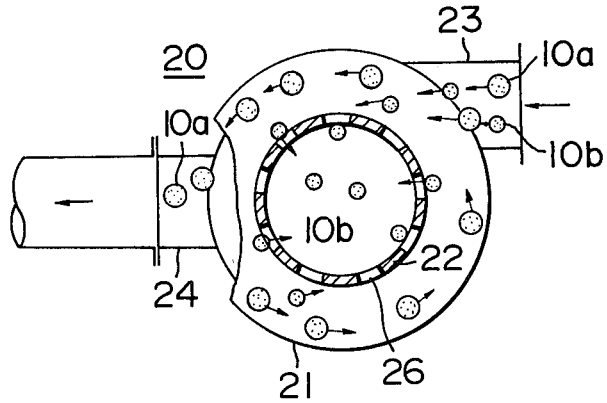
FIG. 2 is a cross-sectional view of the sorting apparatus taken along the line II—II of FIG. 1.

Referring now to the drawings wherein like reference numerals are used throughout the various views to designate like parts and, more particularly, to FIGS. 1 and 2, according to these figures, a sorting apparatus generally designated by the reference numeral 20 for sorting sponge balls used for cleaning the inner surfaces of the cooling tubes of a condenser includes a conical casing 21 having a circular cross-section, with a frusto-conical sleeve 22 being disposed at a center of the casing 21 and having an axis extending in the same direction as the longitudinal center axis of the casing 21. The sleeve 22 is provided with a peripheral wall having a mesh or apertures, with the mesh or the apertures being so sized and shaped so as to permit only the worn down cleaning balls to pass therethrough. Preferably, the aperture 26 is sized to have the same diameter as the inside diameter of the condenser cooling tube to be cleaned, because the fresh and valid sponge balls have a diameter about 1.5 mm greater than the inside diameter of the condenser cooling tubes, and the sponge balls which have been worn down to the same diameter as the inside diameter of the condenser cooling tube can no more provide good cleaning effect. The casing 21 is further provided with an inlet pipe 23 through which the cleaning balls **10*a*, 10*b* are introduced into the casing 21 in the tangential direction of the latter and an outlet pipe 24 through which the valid cleaning sponge balls 10*a* are taken out of the casing after the sorting. More specifically, the inlet pipe 23 is connected to an upper portion of the casing 21, while the outlet pipe 24 is connected to a lower portion of the same at a position circumferentially spaced from the inlet pipe 23. A discharge pipe 25, for discharging the worn down cleaning sponge balls 10*b* which have been taken into the frusto-conical sleeve 22 past the apertures 26, is connected to the upper end of the casing 21 adjacent to the large-diameter end of the frusto-conical sleeve 22. The arrangement is such that the worn out cleaning sponge balls 10*b* are discharged together with the cooling water from the upper axial end of the casing 21 past the frusto-conical sleeve 22 and the discharge pipe 25. The frusto-conical sleeve 22 is disposed such that its large-diameter end and small-diameter end are located adjacent to the inlet pipe 23 and the outlet pipe 24, respectively. In addition, the perforations for permitting only the worn out cleaning sponge balls 10***b* are formed in the region below the opening of the inlet pipe 23 to the casing 21, i.e. in the area between the opening of the inlet pipe and the small-diameter end of the frusto-conical sleeve. By so doing, it is possible to form a swirling flow passage for the cooling wate suspending the cleaning sponge balls 10*a*, 10*b* and introduced into the annular area between the inner peripheral surface of the casing 21 and the outer peripheral surface of the frusto-conical sleeve 22, so as to impart a strong swirl to the cooling water in the casing 21 thereby to promote the sorting of the cleaning sponge balls 10*a*, 10*b* to sort the worn out balls 10*b* from other balls 10*a* at a high efficiency.

In operation, the valid sponge balls 10*a* and the worn out sponge balls 10*b*, which are introduced into the casing 21 in the tangential direction of the latter together with the cooling water, are made to flow in a strong swirl as then pass through the swirling passage formed between the inner peripheral surface of the casing 21 and the outer peripheral surface of the frusto-conical sleeve 22. In this swirling flow, the valid sponge balls 10*a* having larger diameters and, hence, greater masses, are made to flow along the inner peripheral surface of the casing 21 due to the action of the centrifugal force generated as a result of the swirling, while the worn out sponge balls 10*b* having smaller diameters and, hence, smaller masses, are concentrated mainly in the area near the outer peripheral surface of the frusto-conical sleeve 22 because of the smaller level of the centrifugal force.

The arrangement is made such that the cooling water introduced into the casing 21 and making a swirling flow is forced into the frusto-conical sleeve 22 through the apertures 26 and discharged out of the sorting apparatus through the discharge pipe 25. Therefore, the worn out sponge balls 10*b* having small masses, flowing around the frusto-conical sleeve 22, are introduced together with the cooling water into the frusto-conical sleeve 22 through the apertures 26 and then discharged to the outside through the discharge pipe 25. Meanwhile, the valid sponge balls 10*a* rotatively flowing within the casing are forced to move radially outwadly, i.e. toward the inner peripheral surface of the casing 21 due to the centrifugal force. It is, therefore, possible to take out these valid sponge balls 10*a* to the outside of the sorting apparatus by selectively opening a valve disposed in the outlet pipe 24, for repeated use in the cleaning system of the condenser. Since the sleeve 22 and the casing 21 are designed to have frusto-conical shapes, the cross-sectional area of the swirling passage formed therebetween is gradually narrowed to gradually increase the velocity of the swirling flow to impart greater centrifugal force to the valid sponge balls 10*a*, thereby obtaining a higher efficiency of sorting of the worn out sponge balls, while permitting the accumulation of the valid sponge balls 10*a* at the bottom of the casing 21. Namely, by keeping the valve of the outlet pipe 24 in the closed state, it is possible to temporarily store the valid sponge balls 10*a* in the casing 21, without returning the same to the cleaning system of the condenser. By keeping the valve of the outlet pipe 24 closed, the worn out sponge balls 10*b* are continuously discharged through the discharge pipe 25 together with the cooling water, while the valid sponge balls 10*a* stay in the casing 21 to maintain the swirling flow together with the cooling water.

The sorting apparatus of the invention having the construction heretofore described offers the following advantages:

A large separation area for sorting the worn out sponge balls 10*b* from the valid sponge balls 10*a* is presented by the frusto-conical separation sleeve 22 having an axis extended along the axis of the swirling flow. In addition, it is possible to concentrate the valid sponge balls 10*a* in the area near the inner peripheral surface of the casing 21, while concentrating the worn out sponge balls 10*b* in the area near the outer peripheral surface of the frusto-conical sleeve 22, thereby promoting the sorting of the worn out sponge balls 10*b* from the valid sponge balls 10*a*.

The apertures 26 of the frusto-conical sleeve 22 is never blocked by the valid sponge balls 10*a* having large diameters, because the valid sponge balls 10*a* are concentrated in the area remote from the frusto-conical sleeve 22.

Since the sorting operation is made by making an efficient use of the swirling flow generated by the dynamic pressure of the cooling water, it is not necessary to employ any manual labor nor a specific power source.

Figure 3:
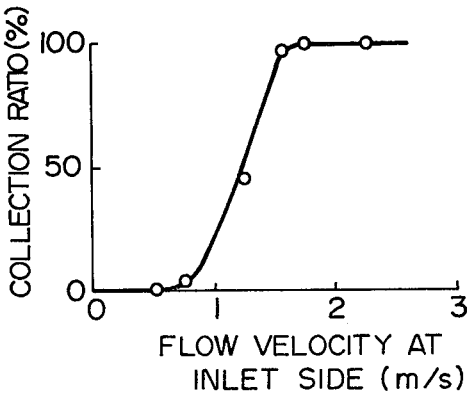
FIG. 3 is a graphical illustration of results of a test conducted for confirming the sorting performance of the sorting apparatus shown in FIG. 1.

A test was conducted to confirm the sorting effect performed by the sorting apparatus of the invention, adopting various flow velocities $V_1$ at the inlet pipe 23 of 100 $\phi$ using sponge balls of various diameters 5 $\phi$, 7 $\phi$, 9 $\phi$ and 13 $\phi$. The result of this test is shown in FIG. 3. In this Figure, the term "collection ratio" means the ratio of the number of balls which have passed through the apertures of 7 $\phi$ which are the apertures 26 of the frusto-conical sleeve 22 to the total number of the sponge balls 10*a*, 10*b* put into the cooling water and having the same size as those collected through the apertures 26. As a natural result, only the sponge balls of 5 $\phi$ and 7 $\phi$ could be collected through the apertures, while the sponge balls having the diameters greater than the diameter 7 $\phi$ of apertures were taken out through the outlet pipe 24. From FIG. 3, it will be understood that the sorting effect becomes appreciable as the flow velocity $V_1$ exceeds about 0.8 m/sec and a perfect sorting is achieved when the flow velocity is higher than about 1.5 m/sec.

Figure 4:
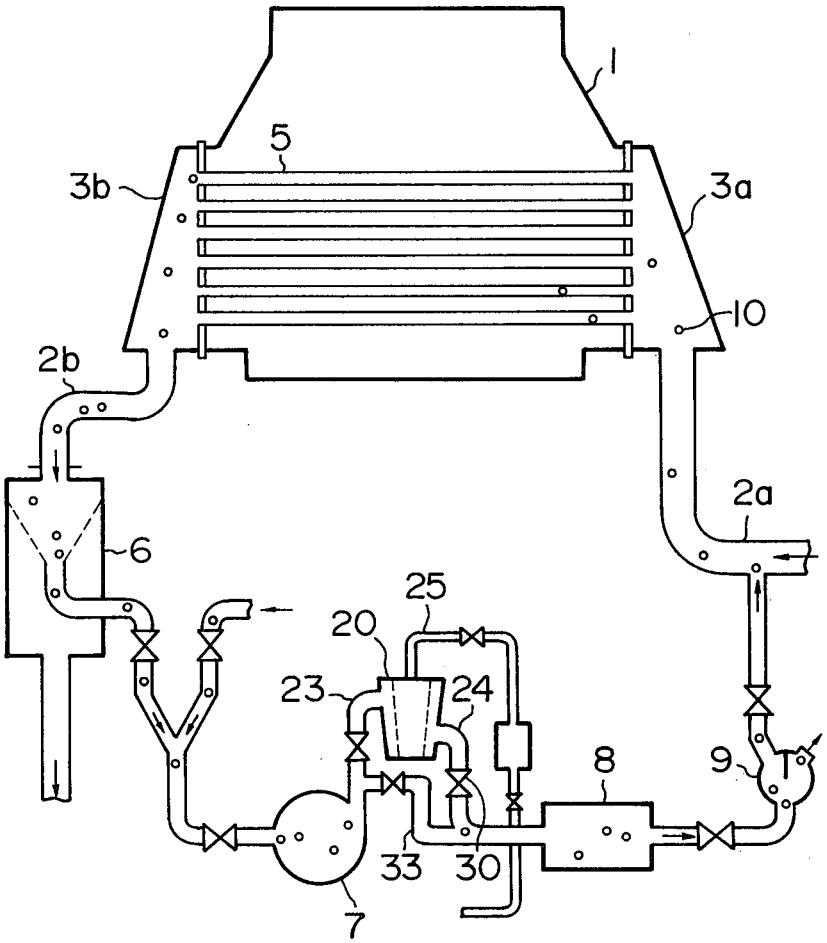
FIG. 4 is a schematic view of a cleaning ball circulation system of a condenser, having a sorting apparatus shown in FIG. 1.

As shown in FIG. 4, for cleaning the inner surfaces of cooling pipes 5 of a condenser 1 by means of cleaning sponge balls 10 circulated therethrough, a pump 7 is started to supply the cleaning sponge balls 10 from a ball collector 8 in which the balls 10 are stored into a cooling water pipe 2*a* communicating with the cooling water inlet chamber 3*a* of the condenser, through a distributor 9. The sponge balls 10 are then distributed over the entire area of the inlet chamber 3*a* and flow into each of a plurality of the cooling pipes 5 to mechanically remove contaminants from the inner surface of each cooling tube. The cleaning sponge balls 10 coming out of the cooling tubes then flow into the a cooling water outlet chamber 3*b* of the condenser and then discharged out of the latter through a cooling water pipe 2*b*. The sponge balls 10 are then arrested by a ball strainer 6, disposed in the cooling water pipe 2*b*, and returned by means of the pump 7 to the ball collector 8. The sponge balls 10 are then recirculated through the condenser 1 repeatedly until the cooling pipes 5 are completely cleaned.

In the cleaning process described above, a part of the sponge balls 10 delivered by the pump 7 are introduced into the cleaning sponge ball sorting apparatus 20 of the invention through the inlet pipe 23 shunting from the delivery side of the pump 7. The ball sorting apparatus 20 functions in the manner explained before in connection with FIGS. 1 to 3, to sort the worn out sponge balls 10*b* from valid sponge balls 10*a*. The valid sponge balls 10*a* are supplied into the ball chamber 8 through the outlet pipe 24 and the valve 30 for repeated use in the cleaning of the cooling tubes of the condenser, while the worn out sponge balls 10*b* sorted from the valid ones by the sorting apparatus 20 are discharged to the out of the system through the discharge pipe 25.

Although the invention has been described through a specific embodiment applied to a cleaning system for cleaning the cooling tubes of a condenser, it will be clear to those skilled in the art that the invention is equally applicable to cleaning system of a heat exchanger having heat transfer tubes other than the condenser.

As has been described, according to the invention, it is possible to effect the sorting of bodies suspended in a liquid according to the sizes of the body at a high precision to the utilization of the swirling of the liquid.

What is claimed is:

1. A sorting apparatus for sorting bodies suspended in a liquid according to the size of said bodies, the apparatus comprising: a casing having a circular cross-section and provided with and inlet pipe through which said bodies are introduced together with said liquid; a separation sleeve disposed at a center of said casing and cooperating with an inner peripheral surface of said casing and defining therebetween a swirling passage for imparting a swirl to said liquid, said separation sleeve having a peripheral wall in which are formed a plurality of apertures sized and shaped to permit only the bodies smaller than a predetermined size to pass therethrough, a discharge pipe connected to said casing and adapted for discharging the bodies of small sizes which have passed through said apertures into said separation sleeve, and an outlet pipe also connected to said casing and adapted for taking out the bodies greater than said predetermined size.

2. A sorting apparatus as claimed in claim 1, wherein the outside diameter of said separation sleeve is changed along a longitudinal axis of said separation sleeve.

3. A sorting apparatus as claimed in claim 1, wherein said inlet pipe is extended in a tangential direction of said casing.

4. A sorting apparatus as claimed in claim 1, wherein said inlet pipe is connected to an upper portion of wall of said casing while said outlet pipe is connected to a lower portion of wall of said casing.

5. A sorting apparatus as claimed in claim 4, wherein said separation sleeve has a substantially frusto-conical form with a large-diameter end and small-diameter end thereof located adjacent to said inlet pipe and said outlet pipe, respectively.

6. A sorting apparatus as claimed in claim 5, wherein said sorting apparatus is incorporated in a sponge-ball type cleaning system for cleaning heat transfer tubes of a heat exchanger.

7. A sorting apparatus as claimed in claim 1, wherein said bodies are elastic bodies.

8. A sorting apparatus as claimed in claim 7, wherein said elastic bodies are sponge balls used for cleaning an inner surfaces of heat transfer tubes.

9. A sorting apparatus as claimed in claim 1, wherein said separation sleeve has an axial length substantially corresponding to an axial length of said casing such that the swirling passage extends substantially along the entire axial length of the casing.

10. A sorting apparatus as claimed in claim 9, wherein said inlet pipe and said outlet pipe are connected, respectively, to upper and lower portions of the wall of said casing, and wherein said separation sleeve has a substantially frusto-conical form with a large-diameter end and small-diameter end thereof located adjacent to said inlet pipe and said outlet pipe, respectively.

11. A sorting apparatus as claimed in claim 10, wherein said inlet pipe is extended in a tangential direction of said casing.

12. A sorting apparatus for sorting elastic balls for cleaning heat transfer tubes of a heat exchanger, the apparatus comprising: a casing having a circular cross-section and provided with an inlet pipe extended in a tangential direction of said casing through which said elastic balls are introduced together with the liquid, a separation sleeve disposed at the center of said casing and cooperating with the inner peripheral surface of said casing in defining therebetween an annular swirling passage for imparting a swirl to said liquid, said separation sleeve having a circular cross-section defined by a peripheral wall in which are formed a plurality of apertures sized and shaped to permit only worn-out elastic balls having sizes smaller than a predetermined size to pass therethrough, a discharge pipe connected to said casing and adapted for discharging said worn-out elastic balls which have been introduced into said separation sleeve through said apertures, and an outlet pipe also connected to said casing and adapted for discharging valid elastic balls of sizes greater than said predetermined size.

13. A sorting apparatus as claimed in claim 12, wherein said inlet pipe and said outlet pipe are connected, respectively, to upper and lower portions of the wall of said casing, and wherein said separation sleeve has a substantially frusto-conical form with a large-diameter end and small-diameter end thereof located adjacent to said inlet pipe and said outlet pipe, respectively.

* * * * *